United States Patent [19]

Dickie

[11] Patent Number: 4,972,954

[45] Date of Patent: Nov. 27, 1990

[54] PRODUCT SUPPORTING SHOCK RESISTANT PACKAGING INSERT

[75] Inventor: Robert G. Dickie, Newmarket, Canada

[73] Assignee: Intepac Technologies, Inc., Markham, Canada

[21] Appl. No.: 551,380

[22] Filed: Jul. 9, 1990

[51] Int. Cl.[5] ..... B65D 81/04; B65D 85/30

[52] U.S. Cl. ..... 206/523; 206/586; 206/592; 248/345.1

[58] Field of Search ..... 206/523, 586, 591, 592, 206/593, 453; 217/52, 53, 35; 229/DIG. 1; 248/345.1

[56] References Cited

U.S. PATENT DOCUMENTS

| | | | |
|---|---|---|---|
| 3,314,584 | 4/1967 | Knapp et al. | 206/586 |
| 3,564,811 | 2/1971 | Freeman | 53/474 |
| 3,572,574 | 3/1971 | Mears | 206/523 |
| 3,580,469 | 5/1971 | Reese | 206/523 |
| 3,655,112 | 4/1972 | Jeffers | 206/586 |
| 3,695,421 | 10/1972 | Wood | 206/523 |
| 3,854,650 | 12/1974 | Hanaue | 206/523 |
| 3,900,156 | 8/1975 | Clark, Jr. | 206/586 |
| 3,938,661 | 2/1976 | Carmody | 206/523 |
| 3,973,720 | 9/1976 | Schmid | 229/DIG. 1 |
| 3,994,433 | 11/1976 | Jenkins et al. | 206/523 X |
| 4,122,946 | 10/1978 | Holley | 206/523 |
| 4,709,817 | 12/1987 | Deady et al. | 206/523 |

*Primary Examiner*—Paul T. Sewell
*Assistant Examiner*—Jacob K. Ackun, Jr.

[57] ABSTRACT

To form a product supporting packaging insert, a substantially rectangular flat blank of a material such as polyproplene foam, corrugated cardboard, or honeycomb cardboard is die cut to form a lateral end segment at one end of the blank, a pair of longitudinal parallel side segments adjoining the lateral end segment, and a longitudinal central segment adjoining the lateral end segment. The central segment of the blank is provided with a tab receptacle at its end facing the end segment and the end segment is provided with a tab facing the end of the blank. To assemble a product supporting packaging insert from the blank, the end segment of the blank is pivoted on fold lines separating it from the side segments and the tab inserted into the tab receptacle. As a result, the ends of the side segments nearest the end segment are pivoted away from the corresponding end of the central segment to provide top and bottom support and protection for a product or product package, with side, end, and corner protection provided by the central and end segments.

5 Claims, 2 Drawing Sheets

PRODUCT SUPPORTING SHOCK RESISTANT PACKAGING INSERT

TECHNICAL FIELD

This invention relates generally to packaging inserts and more particularly to packaging inserts for supporting products within outer shipping cartons and protecting the supported products against external shock.

BACKGROUND OF THE INVENTION

When shipping fragile products, it is desirable to provide protection against external shock which is as complete as possible and, at the same time, minimize both packaging and shipping costs. Foam inserts at the ends or corners of a shipping carton are commonly cut or glued to shape in order to support either the product or an internal package enclosing the product at each end or at all corners and protect it against damage which might otherwise be caused by external forces applied to the top, bottom, sides, ends, or corners of the shipping carton. For small packages, corrugated or honeycomb cardboard inserts are commonly used to the same end. Inserts with complex three-dimensional shapes, particularly when parts need to be glued during the assembly process, tend to add undesirably to packaging costs and, hence, to total shipping costs. The present invention avoids any need for either gluing or complex three-dimensional shapes and permits inserts to be die cut from a single flat blank which can then be simply snapped into its assembled position for insertion into an outer shipping carton to provide the desired product protection.

SUMMARY OF THE INVENTION

The invention generally takes the form of a substantially rectangular flat blank form for forming into a product supporting packaging insert by a simple die cutting process. A single blank may, if desired, provide the insert for only a single corner or may, alternatively, by providing the necessary support for two adjacent corners, constitute a packaging insert for the entire end of an outer shipping carton. In particular, the invention takes the form of a rectangular blank having a lateral end segment at one end of the blank, a pair of longitudinal parallel side segments each bounded at one end by the lateral segment, a longitudinal central segment located between the side segments and bounded at one end by the lateral end segment, the lateral end segment having a tab facing the end of the blank and the central segment having a tab receptacle facing the lateral segment, a first pair of lateral fold lines permitting the side segments to pivot away from the end of the central segment nearest the lateral end segment, and a second pair of lateral fold lines permitting the lateral segment to pivot about the ends of the side segments to fit the tab into the tab receptacle. The end of the blank containing the tab is thus folded back to a more centrally located part of the blank, defined specifically by the tab receptacle. When the packaging insert is assembled in this manner, the central and lateral segments of the blank provide end, side, and corner protection and the side segments provide top and bottom protection. The blank can be manufactured by a simple die cutting process and neither gluing nor complex three-dimensional shapes are neccessary. Because substantially all material in the blank is used in the end product there is, furthermore, no need to have waste material removed manually after the die cutting is completed.

When considered from the standpoint of the die cutting process, the invention takes the form of a substantially rectangular flat blank having a pair of outboard extended longitudinal cuts spaced apart from the sides and beginning at one end of the blank, the outboard cuts being interrupted for like intervals a set distance from the end of the blank, a pair of inboard shorter longitudinal cuts spaced apart from the outboard cuts, the inboard cuts being interrupted for substantially the same intervals and at substantially the same distance from the end of the blank as the outboard cuts, a first of lateral cuts between respective ones of the outboard and inboard cuts at one end of the interruption intervals, a second pair of lateral cuts between repective ones of the outboard and inboard cuts at the other end of the interruption intervals, a single lateral cut between the ends of the inboard cuts farthest from the end of the blank, a first pair of lateral fold lines between the outboard cuts and the sides of the blank at a distance between the second pair of lateral cuts and the single lateral cut, and a second pair of lateral fold lines between the outboard cuts and the sides of the blank at the ends of the outboard cuts farthest from the end of the blank. In such a die cut blank, the portion of the blank bounded by the inner segments of the inboard cuts and the single lateral cut forms the tab receptacle. The portion of the blank bounded by the inner segment of the outboard cuts, the second pair of lateral cuts, and the single lateral cut forms the central segment. The portions of the blank bounded by the outboard cuts, the first lateral fold lines, and the sides of the blank form the side segments. Finally, the portion of the blank bounded by the end of the blank, the second pair of lateral fold lines, the second pair of lateral cuts, and the single lateral cut forms the lateral end segment. The various cuts extend all the way through the material of the blank, while fold lines may be formed by "T" notches or partial cuts in that material or by other equivalent processes.

In many embodiments of the invention, the blank material is foamed plastic material such as foamed polyproplene, foamed polyethylene or foamed polyurethane. In others, such materials as laminated corrugated or honeycomb cardboard may be used instead. As has already been pointed out, a single die cut blank may provide either corner support alone or, by including support for two adjacent corners in a single blank, complete end support.

Because the end or corner support structure of the present invention is provided from a single flat die cut blank, initial fabrication costs tend to be minimal. Neither complex three-dimensional shapes nor gluing processes are needed. When a product or an inner carton containing it is suspended within an outer shipping carton by such packaging inserts, it is protected as completely as possible from shocks resulting from external forces applied from top, bottom, sides, ends, or corners of the outer carton. Significant savings in warehouse space for storing materials are afforded because all materials may be stored as flat sheets. Labor cost associated with packaging assembly are reduced because the assembly process is inherently simple and not prone to error.

The invention may be better understood from the following more detailed description of several specific embodiments, taken in the light of the accompanying drawing and the appended claims.

DETAILED DESCRIPTION

Figure 1:
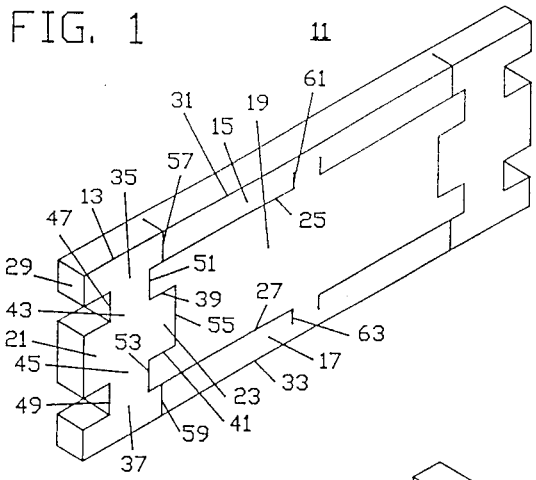
FIG. 1 is a view of a double ended flat die cut blank embodying the invention and providing support, in its assembled form, for two adjacent corners of a product or an inner carton enclosing it.

In FIG. 1, a double ended flat die cut blank 11 of foamed plastic material has a lateral end segment 13, a pair of longitudinal parallel side segments 15 and 17, and a longitudinal central segment 19. End segment 13 has a tab 21 and central segment 19 has a tab receptacle 23, the latter being outlined by portions of the boundary cuts between end segments 13 and central segment 19. As shown, a pai of outboard longitudinal cuts 25 and 27 begin at one end 29 of blank 11 and are spaced apart from sides 31 and 33, respectively, with interruptions 35 and 37 at like intervals at set distances from end 29 of the blank. A pair of inboard longitudinal cuts 39 and 41 also begin at end 29 of blank 11 but are shorter than outboard cuts 25 and 27 and have interruptions 43 and 45 at the same distance from end 29 and for the same intervals as interruptions 35 and 37. A first pair of lateral cuts 47 and 49 extend between respective ones of outboard cuts 25 and 27 and inboard cuts 39 and 41 at the ends of interruptions 35, 37, 43, and 45 nearest to end 29. A second pair of lateral cuts 51 and 53 extend between respective ones of outboard cuts 25 and 27 and inboard cuts 39 and 41 at the other ends of interruptions 35, 37, 43, and 45. Finally, a single lateral cut 55 extends between the ends of inboard cuts 39 and 41 remote from end 29. All cuts extend all the way through the material of blank 11.

In addition to the cuts which have already been described, blank 11 in FIG. 1 has several fold lines. A first pair of fold lines 57 and 59 extend between respective ones of outboard cuts 25 and 27 and sides 31 and 33 substanially midway between lateral cuts 51 and 53 and single lateral cut 55. A second pair of fold lines 61 and 63 extend between respective ones of outboard cuts 25 and 27 and sides 31 and 33 and the ends of outboard cuts 25 and 27 farthest from end 29. While the various cuts which have been described extend all the way through blank 11, the fold lines represent partial cuts only, so that fold lines 57 and 59 permit pivoting on the side of blank 11 away from the observer in FIG. 1 and fold lines 61 and 63 permit pivoting on the side of blank 11 toward the observer.

Lateral end segment 13 of blank 11 in FIG. 1 is bounded by lateral fold lines 57 and 59, lateral cuts 51 and 53, single lateral cut 55, the end of outboard longitudinal cuts 25 and 27, the ends of inboard longitudinal cuts 39 and 41, lateral cuts 47 and 49, sides 31 and 33, and end 29 of blank 29. Longitudinal side segments 15 and 17 are bounded by respective ones of sides 31 and 33, lateral fold lines 57 and 59, outboard longitudinal cuts 39 and 41, and lateral fold lines 61 and 63. Longitudinal central segment 19 is boundel by outboard longitudinal cuts 25 and 27, the interior ends of inboard longitudinal cuts 39 and 41, lateral cuts 51 and 53, and single lateral cut 55. Tab 21 of end segment 13 is bounded by the ends of inboard cuts 39 and 41 nearest end 29 and by blank end 29 itself. Tab receptacle 23 is part of longitudinal central segment 19 and is bounded by the ends of inboard cuts 39 and 41 farthest from end 29 and by single lateral cut 55.

Although only one end of die-cut blank 11 in FIG. 1 has been described, the other is similar and symmetrical with it. A double ended packaging insert assembled from blank 11 is illustrated in different perspectives in FIGS. 2 and 3.

Figure 2:
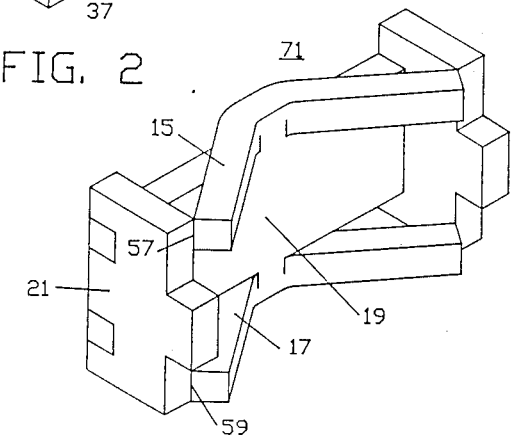
FIG. 2 is a view of one side of the die cut blank of FIG. 1 in its assembled form.

In FIG. 2, a double ended assembled packaging insert 71 is viewed from an interior perspective, with central segment 19 at the rear and side segments 15 and 17 extended toward the observer. End section 13 has been pivoted away from the observer along fold lines 57 and 59 and tab 21 has been locked into the tab receptacle, shaped similarly to itself, in central segment 19. As illustrated, side segments 15 and 17 serve to provide respective top and bottom support and protection for a packaged product, while central segment 19 and end segment 13 provide end, side, and corner protection. The inherent memory of the material of insert 71, it will be noted, tend, to force interlocking corners of the insert together rather than trying to separate them.

Figure 3:
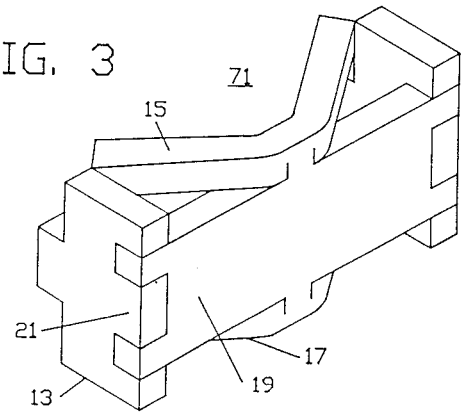
FIG. 3 is a view of the other side of the die cut blank of FIG. 1 in its assembled form.

In FIG. 3, the same packaging insert 71 is viewed from an exterior perspective, with central segment 19 in front and side segments 15 and 17 extending away from the observer. Again, tab 21 is shown locked into the tab receptacle of central segment 19.

Figure 4:
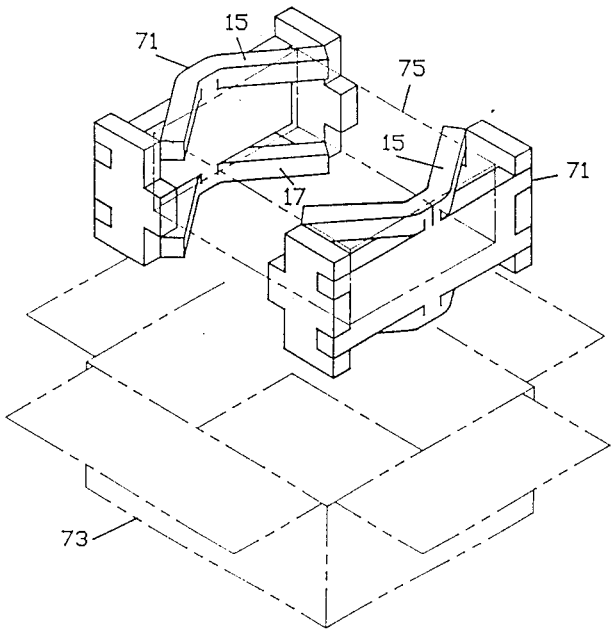
FIG. 4 shows how two assembled die cut blanks of the type shown in FIG. 1 fit into an outer shipping carton to support an inner carton containing the product.

In FIG. 4, an outer shipping carton 73 and inner shipping carton 75 are both shown in dashed lines to illustrate how two double ended packaging inserts 71 embodying the invention may be used to provide top, bottom, side, end, and corner shock protection for a fragile product contained within inner carton 75. Each insert 71 is a fully assembled insert as illustrated in FIGS. 2 and 3. As shown, both inserts 71 have the pivoted faces of said segments 15 and 17 facing the interior of outer carton 73.

Figure 5:
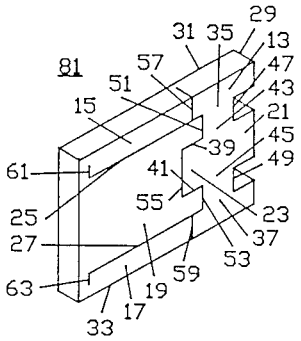
FIG. 5 is a view of a single ended die cut blank embodying the invention and providing support for a single corner of a product or an inner carton enclosing it.

In FIG. 5, a single ended flat die cut blank 81 of foamed plastic material embodies the invention and has the same components as does the half of double ended blank 11 described in connection with FIG. 1. The components in FIG. 5 bear the same reference numerals as corresponding components in FIG. 1 and need not be redescribed. All functions are substantially indentical. As in FIG. 1, blank 81 in FIG. 5 has a lateral end segment 13, a pair of longitudinal parallel side segments 15 and 17, and a longitudinal central segment 19. End segment has a tab 21 and central segment 19 has a tab receptacle 23. Single ended blank 81 is illustrated in assembled form from different perspectives in FIGS. 6 and 7.

Figure 6:
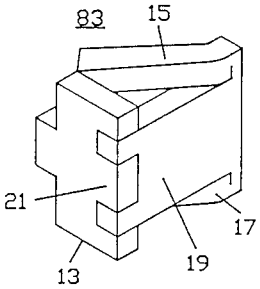
FIG. 6 is a view of one side of the die cut blank of FIG. 5 in its assembled form.

In FIG. 6, a single ended packaging insert 83, assembled from blank 81 in FIG. 5, is viewed from an exterior perspective, with central segment 19 in front and side segments 15 and 17 extending away from the observer. Tab 21 is shown locked into the tab receptacle of central segment 19.

Figure 7:
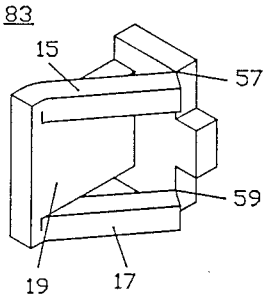
FIG. 7 is a view of the other side of the die cut blank of FIG. 5 in its assembled form.

In FIG. 7, the same packaging insert 83 is viewed from an interior perspective, with central segment 19 in front and side segments 15 and 17 extending toward the observer. End section 13 has been pivoted away from the observer along fold lines 57 and 59 and tab 21 has been locked into the tab receptacle, shaped similarly to itself, in central segment 19. As shown, side segments 15 and 17 serve to provide respective top and bottom support and protection for a packaged product, while central segment 19 and end segment 13 provide end, side, and corner protection.

It is to be understood that the embodiments of the invention which have been described are illustrative. Numerous other arrangements and modifications may be readily devised by those skilled in the art without departing from the spirit and scope of the invention.

What is claimed is:

1. A substantially rectangular flat blank for forming into a product supporting packaging insert, characterized by a lateral end segment at one end of said blank, a pair of longitudinal parallel side segments each bounded at one end by said lateral segment, and a longitudinal central segment located between said side segments and bounded at one end by said lateral segment, said lateral end segment having a tab facing said end of said blank and said central segment having a tab receptacle facing said lateral end segment, a first pair of lateral fold lines permitting said side segments to pivot away from the end of said central segment nearest said lateral end segment, and a second pair of lateral fold lines permitting said lateral segment to pivot about the ends of said side segments to fit said tab into said tab receptacle, said central and lateral segments providing end, side, and corner protection and said side segments providing top and bottom protection for a supported product when said blank is in its assembled condition.

2. A substantially rectangular product supporting packaging insert blank in accordance with claim 1, further characterized by a pair of outboard extended longitudinal cuts spaced apart from the sides and beginning at one end of said blank, said outboard cuts being interrupted for like intervals a set distance from said end of said blank, a pair of inboard shorter longitudinal cuts spaced apart from said outboard cuts, said inboard cuts being interrupted for substantially the same intervals and at substantially the same distance from said end of said blank as said outboard cuts, a first pair of lateral cuts between respective ones of said outboard and inboard cuts at one end of said interruption intervals, the portion of said blank bounded by the end of said blank and the outer segments of said inboard cuts forming said tab, a second pair of lateral cuts between respective ones of said outboard and inboard cuts at the other end of said interruption intervals, a single lateral cut between the ends of said inboard cuts remote from said end of said blank, the portion of said blank bounded by the inner segments of said inboard cuts and said single lateral cut forming said tab receptacle, and the portion of said blank bounded by the inner segment of said outboard cuts, said second pair of lateral cuts, and said single lateral cut forming said central segment, a first pair of lateral fold lines between said outboard cuts and the sides of said blank at a distance between said second pair of lateral cuts and said single lateral cut, the portions of said blank bounded by said outboard cuts, said first lateral fold lines, and the sides of said blank forming said side segments, and a second pair of lateral fold lines between said outboard cuts and the sides of said blank at the ends of said outboard cuts farthest from said end of said blank, the portion of said blank bounded by said end of said blank, said second pair of lateral fold lines, said second pair of lateral cuts, and said single lateral cut forming said lateral end segment.

3. A substantially rectangular product supporting packaging insert blank in accordance with claim 2, further characterized in that said blank is fabricated of foamed plastic material.

4. A substantially rectangular product supporting packaging insert blank in accordance with claim 2, further characterized in that said blank is fabricated of corrugated cardboard.

5. substantially rectangular product supporting packaging insert blank in accordance with claim 2, further characterized in that said blank is fabricated of honeycomb cardboard.

* * * * *